166-308
4/12/77 XR 4,017,121 SR

United States Patent [19]
Trent

[11] 4,017,121
[45] Apr. 12, 1977

[54] LONGWALL MINING OF TRONA WITH PREFRACTURING TO PREVENT SLABBING

[75] Inventor: Robert Harold Trent, Longmont, Colo.

[73] Assignee: Allied Chemical Corporation, Morris Township, N.J.

[22] Filed: Apr. 28, 1975

[21] Appl. No.: 572,250

Related U.S. Application Data

[63] Continuation-in-part of Ser. No. 526,771, Nov. 25, 1974, abandoned.

[52] U.S. Cl. ..... 299/11; 299/16; 166/308

[51] Int. Cl.[2] ..... E21C 27/10; E21C 37/12

[58] Field of Search ..... 299/11, 13, 16, 12; 166/308

[56] References Cited

UNITED STATES PATENTS

| | | | |
|---|---|---|---|
| 3,384,416 | 5/1968 | Ruehl et al. | 299/16 |
| 3,402,968 | 9/1968 | Fischer | 299/11 |
| 3,650,564 | 3/1972 | Williamson | 299/11 |
| 3,778,108 | 12/1973 | Pennington et al. | 299/11 |

*Primary Examiner*—Ernest R. Purser
*Attorney, Agent, or Firm*—Gerhard H. Fuchs; Gerard P. Rooney

[57] ABSTRACT

In dry mining of trona by usual methods such as the room-and-pillar and the long wall mining methods, dust formation, energy requirements, and mining machine wear are reduced and mining tool life is increased by prefracturing the trona in situ prior to mining by (a) driving holes into the trona bed to be mined; (b) introducing fracturing agent into the holes, and (c) causing the fracturing agent to fracture the trona in situ without substantial displacement of the trona so that the prefractured trona will continue to support the overburden.

8 Claims, 4 Drawing Figures

LONGWALL MINING OF TRONA WITH PREFRACTURING TO PREVENT SLABBING

CROSS-REFERENCE TO RELATED APPLICATION

This application is a continuation-in-part of copending application Ser. No. 526,771 filed Nov. 25, 1974, now abandoned and entitled "Improvement in Longwall Mining of Trona".

BACKGROUND OF THE INVENTION

Trona, a mineral having the approximate composition $Na_2CO_3.NaHCO_3.2H_2O$, is extensively mined in the United States from deposits located in southwestern Wyoming. These trona deposits are in the form of horizontally extended beds having thickness of from about 5 to about 15 feet located at a depth from about 800 to about 2000 feet below the surface. These trona beds usually lie between horizontally extending strata of soft shale. The overlying and underlying strata usually have compressive strength in the order of about 3700 psi and are substantially weaker than the trona bed which has a compressive strength of about 7500 psi.

Trona, on acount of its hardness (hardness index of about 2.5 to 3.0), high compressive and tensile strength (about 7500 and 500 psi respectively), brittleness and high density (about 134 lbs./cu.ft.) is very difficult to mine. Energy and forces required to remove trona from subterranean deposits by dry mining techniques are very high, with consequent high mining machine wear and shortened tool life. Further, mining of trona by usual mechanical methods creates large amounts of dust, which is very undesirable from a health and safety standpoint.

The above-described physical characteristics of trona result in particular problems in the longwall mining method. Longwall mining is practiced by driving substantially parallel entries into the trona bed, connecting the entries by at least one primary passage to define a main trona pillar to be mined, supporting the roof of the primary passage by means of movable roof supports or "choks", mining the exposed face of the trona pillar along the primary passage under the protection of the roof supports, removing the mined trona and advancing the roof supports so that these supports remain adjacent and parallel to the exposed face of the trona as it recedes. As the roof supports are moved toward the receding trona face, the unsupported roof behind it collapses and fills with "gob". Longwall mining of trona is described in commonly-assigned U.S. Pat. No. 3,778,108, the disclosure of which is hereby incorporated by reference.

As the trona is removed from the exposed face of the trona pillar along the primary passage, and before the roof supports are advanced toward the recently mined face, the roof directly overhead of the recently mined area is unsupported. In the southwestern Wyoming trona formation, where the overlying and underlying strata are substantially weaker than the trona bed, the unsupported roof and the floor immediately adjacent to the mined area tend to converge, the roof sinking under the weight of the overburden, and the floor heaving as a result of removal of downward pressure. As a result of this convergence, the layer of trona adjacent the face is subjected to concentrated compressive stresses which cause the layer adjacent the face to "buckle away from" the trona bed as the mining along the face of the longwall progresses, causing large "slabs" of trona to break away from the face ("slabbing") and to fall in the way of the mining machine, thereby interrupting the mining operation until these slabs are broken up and cleared away.

Such slabs of trona come in various sizes. They may be no more than one or two feet measured in their largest dimension, in which case they cause no problems, but their largest dimension may equal or even exceed about 20 feet. Slabs measuring more than about 2 to 4 feet in their largest dimension are difficult to handle by conventional longwall mining equipment, and slabs measuring more than about 4 to 5 feet in their largest dimension often require shutdown of the mining operation until they can be cleared away.

It is an object of the present invention to provide an improvement in dry mining of trona to facilitate removal of trona by conventional mechanical methods.

It is another object of the present invention to provide means for eliminating or substantially reducing such "slabbing" of trona in the longwall method of mining which creates "slabs" measuring more than about 4 feet in their largest dimension.

SUMMARY OF THE INVENTION

In its broadest aspects, the present invention concerns an improvement in the mining of a subsurface bed of trona by removal of the trona from the bed by mechanical means, which improvement comprises prefracturing the trona in situ by (a) driving one or more holes into the trona bed to be mined; (b) introducing fracturing agent into the hole or holes; and (c) causing the fracturing agent to fracture the trona in situ without substantial displacement of the trona, so that the fractured trona will remain in place and will continue to support the overburden.

In a more specific aspect, the invention concerns an improvement in the longwall method of mining a subsurface, substantially horizontal bed of trona by driving substantially paralled entries into the trona bed, connecting the entries by at least one primary passage to define a main trona pillar to be mined and mining the exposed face of the trona pillar along the primary passage, by which improvement incidents of "slabbing" are prevented or substantially reduced, and which improvement comprises prefracturing the trona in situ by (a) driving one or more holes into the trona pillar to be mined; (b) introducing fracturing agent into the hole or holes, and (c) causing the fracturing agent to fracture the trona in situ without substantial displacement of the trona, so that the fractured trona will remain in place and will continue to support the overburden.

DESCRIPTION OF THE DRAWINGS

The drawings, wherein FIGS. 1 and 3 are plan views at mine level, and wherein FIGS. 1 and 2, and 3 and 4 respectively illustrate utilization of the improvement of the present invention in the room-and-pillar and the longwall mining methods for mining trona.

Figure 1:
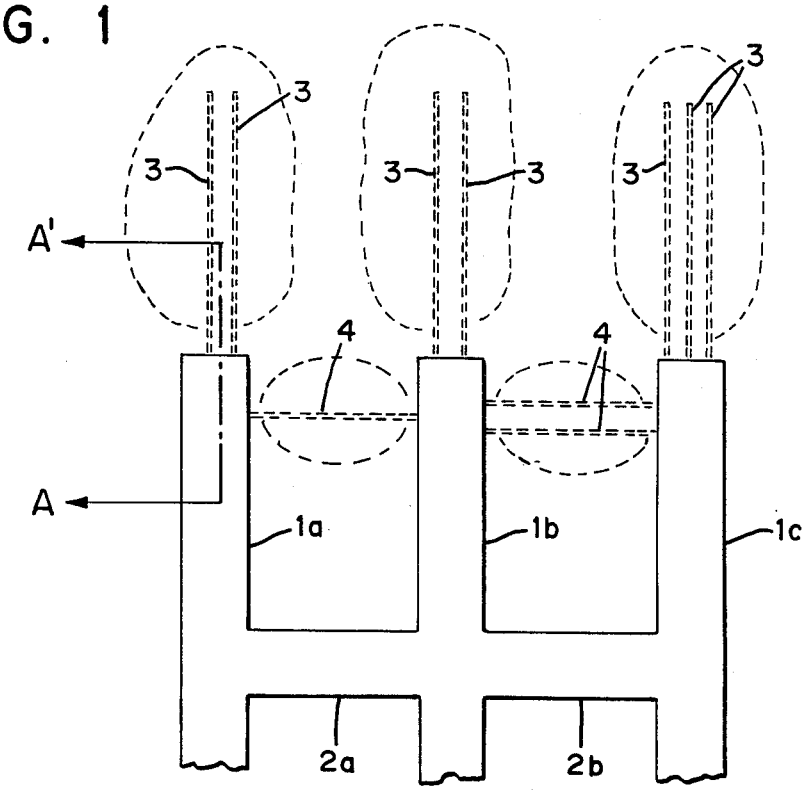

In the plan view of FIG. 1, which illustrates use of my improvement in the room-and-pillar mining method of trona, three sets of parallel entries 1*a*, 1*b* and 1*c* have been driven into the trona bed. They are interconnected by cross-cuts 2*a* and 2*b*. Bore holes 3 have been driven into the trona bed in the direction of mining to extend parallel entries 1*a*, 1*b* and 1*c* further into the trona bed. Bore holes 4 have been driven into the trona wall separating entries 1*a* and 1*b*, and entries 1*b* and 1*c*, perpendicular to the direction of the entries at a point where new cross-cuts are to be made to interconnect the entries. Bore holes 3 and 4, as shown, are ready to receive fracturing agent to effect fracturing of the trona bed in situ without substantial displacement of the trona generally within the areas surrounding the bore holes as indicated by broken lines on FIG. 1.

Figure 2:
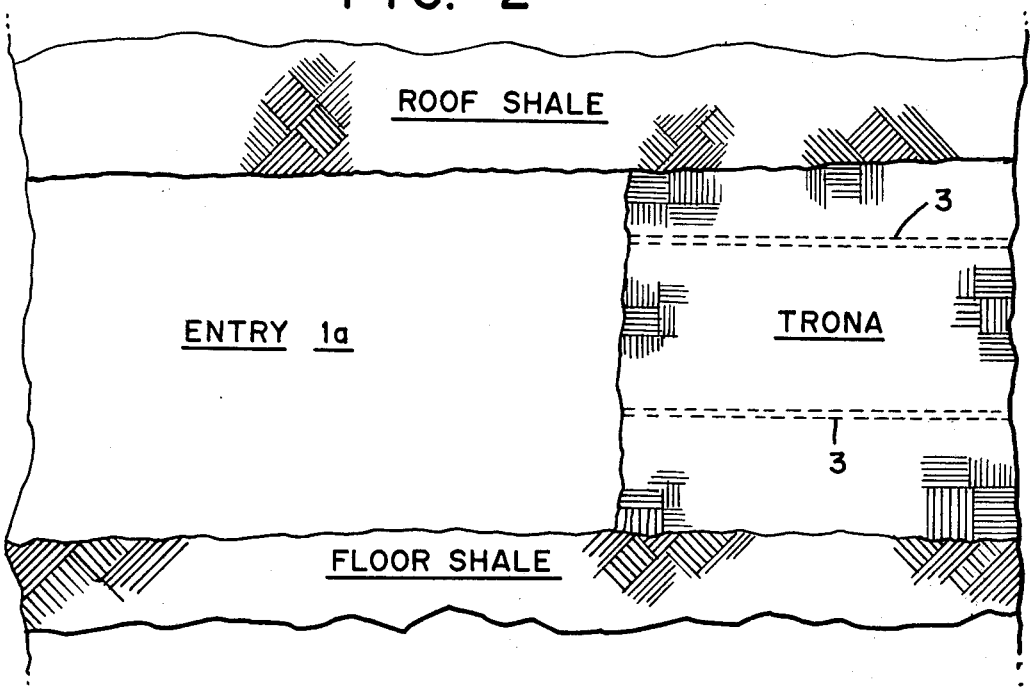
FIGS. 2 and 4 are sectional views on an enlarged scale along lines AA′ of FIGS. 1 and 2, respectively, illustrate specific, preferred embodiments of the present invention.

FIG. 2, a cross-sectional view along line AA' of FIG. 1 on enlarged scale, shows entry 1*a* and bore holes 3 which have been driven into the trona bed in the direction of mining.

Figure 3:
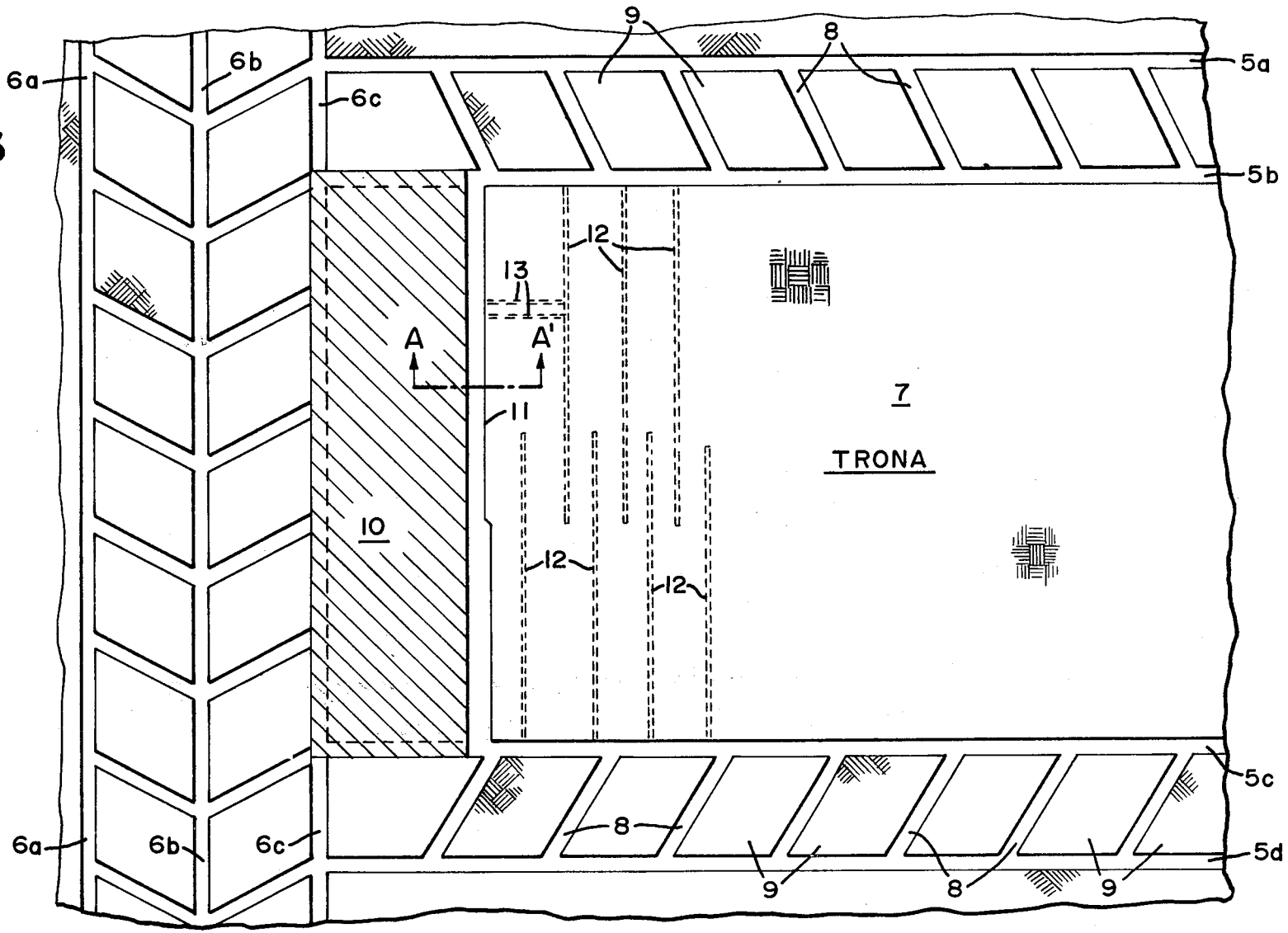

In the plan view of FIG. 3, which illustrates use of my improvement in the longwall mining method of trona, two sets of parallel entries, the first comprising interconnected passageways 5*a* and 5*b* and the second comprising interconnected passageways 5*c* and 5*d* have been driven into the trona bed. These two sets of parallel entries are connected by primary entries 6*a*, 6*b* and 6*c*. These entries together define main trona pillar 7 which is to be mined. Interconnected passageways 5*a*, 5*b* and 5*c*, 5*d* and primary entries 6*a*, 6*b* and 6*c* are transversed by cross-cuts 8 which together with the primary entries form roof supporting pillars 9. Caved area 10 has been mined out and allowed to cave. Mining proceeds along longwall face 11 in direction opposite to the caved area. Bore holes 12, parallel to the longwall face, and bore holes 13, perpendicular to the longwall face, have been driven into trona bed 7 preparatory to introduction of fracturing agent and causing the fracturing agent to fracture trona bed 7 in situ without substantial displacement of the trona so that the prefractured trona will continue to support the overburden. Interconnected passageways 5*a*, 5*b*, 5*c*, 5*d* and primary entries 6*a*, 6*b*, 6*c* provide entrance to and exit from the mined area for men, machinery, material and ventilating air. The mining machine, e.g. a plough or shearer, and the roof supports are omitted from FIG. 3 for the sake of clarity.

Figure 4:
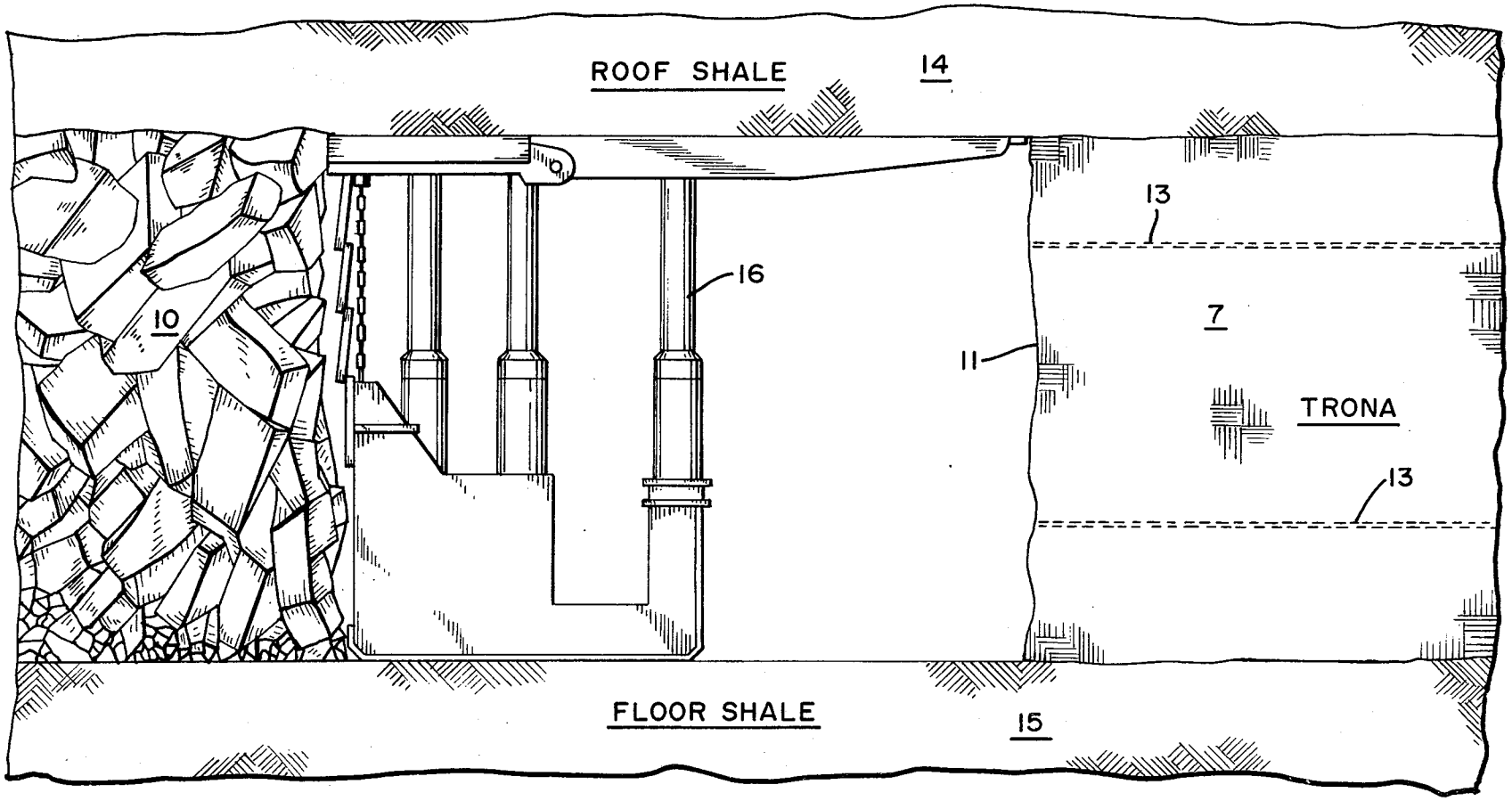

FIG. 4, a cross-section view along line AA' of FIG. 3 on an enlarged scale, shows trona bed 7, longwall face 11, caved area 10 and roof and floor shale 14 and 15 respectively. Movable chucks 16, not shown on FIG. 3, support the roof along longwall face 11 to permit mining of the trona. As the trona is mined, roof support chucks 16 are moved in the direction of receding longwall face 11. Bore holes 13 have been driven into trona bed 7 perpendicular to longwall face 11 preparatory to introduction of fracturing agent and causing the fracturing agent to fracture the trona in situ.

For detailed description of longwall method for mining trona, reference is made to above-noted U.S. Pat. No. 3,778,108, issued December 11, 1973 to Pennington et al.

While in the drawings the bore holes are illustrated as being aligned with the direction of mining (FIGS. 1 and 2), or as being parallel or perpendicular to the longwall face, there is no requirement that they be driven at any particular angle with respect to the direction of mining or the longwall face. They can be driven into the trona bed at any angle which permits placing the fracturing agent within the trona bed such that effective fracturing thereof in situ can be effected by the fracturing agent. Depth of the holes, their spacing with respect to each other and their distance from the outer boundaries of the trona pillar being mined will be principally determined by the distance from the bore hole over which any particular fracturing agent is capable of sufficiently fracturing the trona so as to obtain the abovementioned benefits of the improvement of my invention, without substantial displacement of the trona, and without so weakening the trona as to seriously diminish its capability for supporting the overburden. If the fracturing capability of the chosen fracturing agent under actual use conditions extends only a few feet from the bore hole, say up to about two feet in the average, then the bore holes are preferably spaced on 4 foot centers throughout the trona bed. If the fracturing agent is effective over larger distances, then wider spacing may be employed. Since many factors affect the distance over which any particular fracturing agent is effective, determination of required bore hole spacing may, and should be, determined by simple experiment in each instance under the particular prevailing local conditions. Such determination is simple and is well within the capabilities of those having ordinary skill in the art. The diameter of the bore holes will be principally governed by type of fracturing agent used, that is to say by the diameter and volume requirements of the particular agent employed. For example, if the fracturing agent is a blasting explosive such as ammonium nitrate/fuel oil mixture or dynamite, the holes may be 1 to 2 inches in diameter and they may be spaced on 4 to 10 foot centers.

When used in connection with the longwall mining method, the bore holes are preferably driven sufficiently deep into the trona pillar so that the pillars can be fractured throughout its width, as illustrated in FIG. 3. In the event explosives are used as fracturing agent, holes driven parallel to the longwall are spaced at least about 10 feet from the face of the longwall or else the explosive force might dislocate the trona rather than merely fracture it.

In any event, the bore holes should be spaced from the overlying roof shale a distance sufficient to avoid fracturing or weakening of that shale, or else it will cave immediately over the mined area before roof supports can be put in place. In determining spacing of the bore holes it must be kept in mind that it is not desired to move the trona, but merely to prefracture it so that it will continue to support the overburden.

The holes may be driven into the trona pillar by any suitable means, conventional drilling equipment being eminently suitable for that purpose.

The fracturing agent suitable for use in the present invention may be any means for fracturing the trona bed. "Fracturing" as used herein denotes irreversible structural change in the trona and involves creating breaks in the trona by separation and formation of new surfaces. Fracturing may be the result of tensile stresses, compressive forces, shear forces, or any combination thereof. It may be caused by sudden expansion of the fracturing agent within the bore holes, as by explosion, or by gradual expansion, as by hydraulic forces. It may also be induced by localized heating or cooling, by vibration, e.g. sonic vibration, or generally by any electrical power which can be converted into electrothermal, electromagnetic or electromechanical force within the trona. Thus, any agent which may effect fracturing of trona, be it by mechanical, electrical, acoustical or chemical means, is embraced by the term "fracturing agent" as used herein and is suitable for the practice of the method of the present invention.

One class of suitable fracturing agents includes the blasting explosives such as black powder, dynamites, e.g. straight dynamites, gelatin dynamites, ammonia dynamites and ammonia gelatin dynamites, also nitrostarch dynamites and the "permissable" dynamites, the use of which is particularly desirable under gassy mine conditions, as well as ammonium nitrate blasting explosives, water gel explosives, liquid oxygen explosives and chlorate and perchlorate explosives. The above-provided listing is merely exemplary; many other explosives are known and are suitable for the present purposes. In the event explosives are to be used as fracturing agent, the explosive charge in the bore hole is suitably backed up, as is conventional, as with water bags, wet trona dust or the like in order to prevent or minimize "blowing out" through the bore holes.

Another class of fracturing agents are the hydraulic fracturing agents which include water and any liquid that may be introduced into the bore hole under pressure, such as by pumping, to fracture the trona bed. Usually, pressures in the order of at least about 800 psi are required in order to effect hydraulic fracturing of the trona. Hydraulic pressure within the hole or holes creates fractures and expands existing fractures within the trona. Fracturing ability of such hydraulic fracturing agents may be improved by including therein small amounts of surface active agents, i.e. agents capable of reducing the surface tension of the fracturing agent. This is especially desirable if the hydraulic fracturing agent is an aqueous agent. Exemplary suitable surface active agents include soaps and aminocarboxylates; sulfonates such as lignosulfonate, alkyl benzene sulfonates, petroleum sulfonates, dialkyl sulfo succinates, naphthalene sulfonate, olefin sulfonates and the like; sulfates and sulfated products such as alkyl sulfates, sulfated natural fats and oils, sulfated oleic acid, sulfated alkanolamine, sulfated esters, ethoxylated and sulfated alkylphenols and alcohols, and the like; phosphate esters; polyoxyethylene surfactants; ethoxylated natural fats, oils and waxes; carboxylic esters such as polyethylene glycol esters and polyoxyethylene fatty acid esters and amides; and amines, including guarternary ammonium salts.

Further fracturing agents include thermal fracturing agents, which are means for heating and cooling the trona, and electrical fracturing agents, which are means for applying electrothermal, electromagnetic or electromechanical forces on the trona so as to create localized tensile and/or compressive forces which will fracture the trona. Trona can be fractured by localized heating as, e.g. by means of superheated steam or plasma jet, or by localized cooling as, e.g., with liquid gases such as liquid carbon dioxide. Localized heating within the trona bed may also be effected by applying electrical energy to the trona by means of suitable contacts or probes in the bore hole which will convert the electrical energy applied into electrothermal, e.g. dielectric heating, electromagnetic or electromechanical force.

The herein referred to means for fracturing trona (fracturing agents) are well known to those skilled in the art. The more recently developed electrical means for fracturing minerals are, e.g. described in an article by E. Sarapuu, Electro-Energetic Rock Breaking Systems, *Mining Congress Journal* Vol. 59, p. 44, and by K. Thiramalai, Rock Fragmentation by Creating a Thermal Inclusion With Dielectric Heating, U.S. Dept. of the Interior, Bureau of Mines (1970), to which reference is made hereby.

Often it will be desirable to combine use of two or more methods for fracturing the trona. Thus, for example, it may be desirable to first fracture the trona using explosives and then to follow this up with hydraulic fracturing, e.g. by injecting water, suitably containing a surfactant, under high pressure into the prefractured trona to induce further fracturing.

In general, the method of prefracturing the trona to be employed in the present invention will be selected on the basis of effectiveness, availability and cost, which, to large extent, will depend on prevailing local conditions.

Having described my invention and having set forth the best mode presently contemplated for its practice, the following claims set forth the subject matter which I regard as my invention.

I claim:

1. In the longwall method of mining a sub-surface, substantially horizontal bed of trona by driving substantially parallel entries into the trona bed, connecting the entries by at least one primary passage to define a main trona pillar to be mined, and mining the exposed face of the trona pillar along the primary passage, the improvement which comprises prefracturing the trona in situ to substantially reduce slabbing of the trona at the longwall face by a. driving one or more holes into the trona pillar to be mined;

b. introducing fracturing agent into the hole or holes, and c. causing the fracturing agent to fracture the trona in situ without substantial displacement of the trona so that the prefractured trona will continue to support the overburden and d. mining the exposed, prefractured face of the trona pillar along the primary passage.

2. The improvement of claim 1 wherein the fracturing agent is a blasting explosive.

3. The improvement of claim 1 wherein the fracturing is effected by introducing a hydraulic fracturing agent under pressure into the hole or holes.

4. The improvement of claim 3 wherein the hydraulic fracturing agent is an aqueous agent containing a surface active agent.

5. The improvement of claim 1 wherein the fracturing agent is a thermal fracturing agent.

6. The improvement of claim 5 wherein the thermal fracturing agent comprises means for localized heating of the trona.

7. The improvement of claim 5 wherein the thermal fracturing agent comprises means for localized cooling of the trona.

8. The improvement of claim 1 wherein the fracturing agent is an electrical fracturing agent.

* * * * *